US005881850A

United States Patent [19]

Murdoch

[11] Patent Number: 5,881,850

[45] Date of Patent: Mar. 16, 1999

[54] REMOVABLE SELF-STANDING ARTICLE ORGANIZER ASSEMBLY

[76] Inventor: Douglas H. Murdoch, 2622 Magowan Dr., Santa Rosa, Calif. 95405

[21] Appl. No.: 650,735

[22] Filed: May 20, 1996

[51] Int. Cl.[6] ..... A45C 3/02; A45C 5/12; A45C 13/00

[52] U.S. Cl. ..... 190/110; 190/900; 190/109; 150/113; 206/45.24; 206/320

[58] Field of Search ..... 190/109, 110, 190/900–902, 11, 16; 150/113; 206/45.24, 320, 425

[56] References Cited

U.S. PATENT DOCUMENTS

| | | | |
|---|---|---|---|
| 2,183,428 | 12/1939 | Mc Nary | 150/113 X |
| 2,316,328 | 4/1943 | Guenther et al. | 190/110 X |
| 2,573,763 | 11/1951 | Graham | 190/109 |
| 2,604,917 | 7/1952 | Reilly | 150/113 X |
| 2,612,199 | 9/1952 | Schocket | 150/113 X |
| 2,648,366 | 8/1953 | Higbee et al. | 190/110 X |
| 3,137,374 | 6/1964 | Holtzman | 190/110 |
| 3,306,405 | 2/1967 | Rosenblum | 190/110 |
| 3,533,459 | 10/1970 | Ody | 150/113 |
| 3,958,616 | 5/1976 | Beverstock | 150/113 X |
| 4,161,201 | 7/1979 | Carp | 150/113 X |
| 4,250,938 | 2/1981 | Siegel | 150/113 X |
| 4,265,286 | 5/1981 | Rapoport | 190/900 X |
| 4,651,872 | 3/1987 | Joyce | 206/45.24 X |
| 4,718,524 | 1/1988 | Crumley | 150/113 X |
| 4,736,853 | 4/1988 | O'Mara | 206/224 X |
| 4,754,790 | 7/1988 | Meyers | 150/104 |
| 4,765,462 | 8/1988 | Rose, Jr. | 206/45.24 X |
| 4,796,735 | 1/1989 | Horiuchi | 190/109 |
| 4,852,498 | 8/1989 | Judd | 190/11 X |
| 4,854,432 | 8/1989 | Carpenter et al. | 190/110 |
| 4,871,066 | 10/1989 | Lawall | 190/110 X |
| 5,242,056 | 9/1993 | Zia et al. | 190/110 X |
| 5,379,893 | 1/1995 | Ruiz | 190/900 X |
| 5,524,754 | 6/1996 | Hollingsworth | 206/320 |
| 5,580,914 | 12/1996 | Reiser | 190/485 |

FOREIGN PATENT DOCUMENTS

| | | | |
|---|---|---|---|
| 598671 | 12/1825 | France | 190/109 |
| 344411 | 11/1904 | France | 206/45.24 |
| 615757 | 1/1927 | France | 190/109 |
| 2653312 | 4/1991 | France | 190/110 |
| 6761 | 3/1909 | United Kingdom | 190/109 |
| 9005643 | 5/1990 | WIPO | 206/425 |
| 9201403 | 2/1992 | WIPO | 190/109 |

*Primary Examiner*—Sue A. Weaver
*Attorney, Agent, or Firm*—R. Dabney Eastham

[57] ABSTRACT

A removable self-supporting article organizer assembly contains at least one panel having pockets for storing articles such as pens, business cards, floppy disks, papers and the like and is sized to fit within a compartment in a carrying case. The article organizer assembly may be constructed from two or more spaced panels joined by flexible side walls and end walls defining further pockets for containing files. A hinged flap attached to one of the panels of the article organizer provides a means for supporting the article organizer in a generally upright position when the article organizer is removed from the carrying case. A carrying case adapted to contain the article organizer has a pocket on an internal wall of the carrying case within the compartment. The flap is inserted into a receptacle behind the pocket, thus holding the article organizer assembly securely in position within the compartment yet allowing the article organizer assembly to be easily removed from the carrying case for erection in a generally upright position to provide easy access to the articles stored in the article organizer assembly.

17 Claims, 8 Drawing Sheets

REMOVABLE SELF-STANDING ARTICLE ORGANIZER ASSEMBLY

SUMMARY OF THE INVENTION

The invention provides an article organizer assembly that may be contained and carried in a compartment of a carrying case and may be removed from the carrying case and mounted in a generally upright position for convenient access to articles contained in the article organizer assembly. The invention also provides a carrying case adapted to carry and contain the article organizer assembly.

The article organizer assembly comprises a relatively rigid panel sized to fit within a compartment of a carrying case. At least one side of the panel has at least one pocket for containing or carrying articles such as files, business cards, passports, pens, pencils, staplers, tape dispensers, floppy disks, Post-It® note pads, paper clips, dictating machines, audio tape cassettes, and the like. The panel has means attached to it for supporting the panel in a generally upright position when the panel is removed from the compartment in the carrying case, the supporting means having a first position next to the panel when the panel is in the compartment and a second position extended from the panel when supporting the panel in a generally upright position.

The article organizer assembly may be equipped with means for attaching the article organizer assembly to a wall of the carrying case, adjoining the compartment that contains the article organizer assembly. The supporting means and the attachment means may use some or all of the same components.

The article organizer assembly can be provided with two or more side panels attached by end panels and bottom panels so as to provide a plurality of pockets suitable for containing articles such as files. One of the side panels may contain a plurality of smaller pockets for holding smaller articles such as floppy disks and pens.

The supporting means, in a preferred embodiment, consists of a generally rigid flap hinged to one of the side panels so that it can deploy from a first position next to the side panel to an extended second position suitable for supporting the article organizer assembly in a generally upright position. A lanyard strap may be provided that connects a free end of the flap to the article organizer assembly in order to prevent the flap from hyperextending so that the article organizer assembly is maintained at an inclined but generally upright position when the flap is deployed into the second position.

In a preferred embodiment, the lanyard strap that connects the lower end of the flap to a side panel of the article organizer assembly and prevents hyperextension of the flap is permanently fastened, such as by sewing, to both the lower end of the flap and the article organizer assembly. The pocket on the internal wall of the carrying case intended to receive the article organizer assembly has a slot for receiving the lanyard strap when the flap is inserted into the pocket. The wall of the pocket may be made rigid or semi-rigid in order to retain the flap within the receptacle formed by the pocket.

The carrying case used with the article organizer assembly preferably should be adapted so as to provide coordinating attachment means on a wall adjoining the compartment of the carrying case intended to contain the article organizer assembly. In a preferred embodiment, an internal wall of the carrying case has a pocket into which the flap of the preferred embodiment of the article organizer assembly may be inserted, thus maintaining the article organizer assembly against the wall. Hook and loop fastening strips, plastic or fabric bands or snaps may be provided to further secure the article organizer assembly against the wall of the carrying case.

DETAILED DESCRIPTION OF THE PREFERRED EMBODIMENT OF THE INVENTION

Figure 1:
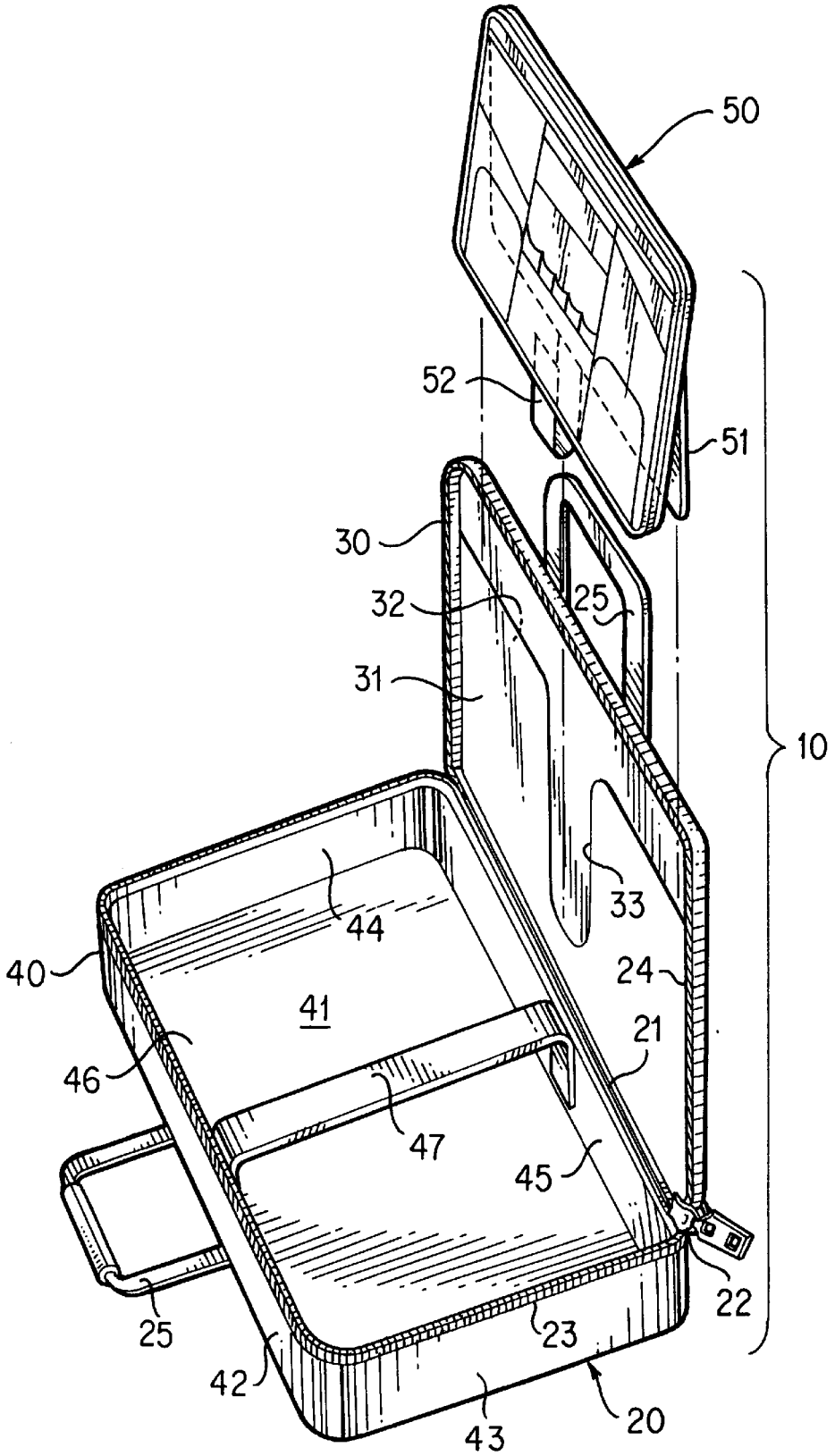
FIG. 1 is a perspective view of a preferred embodiment of a removable self-standing article organizer assembly according to the invention and a carrying case adapted to mount the article organizer assembly within the lid of the carrying case.

The combination of a removable self-standing article organizer assembly 50 and a carrying case 20 adapted to receive the article organizer assembly 50 is indicated generally in FIG. 1 by reference numeral 10. The carrying case 20 contains a lid 30 connected along hinge line 21 to body 40. The body 40 of the carrying case 20 is generally rectangular and has a compartment 41 defined by a front wall 42, first and second side walls 43 and 44, a back wall 45, and a bottom wall 46. The body and the lid are closed together by a continuous self-repairing zipper formed from a zipper coil 23 attached to the body 40 and zipper coil 24 attached to the lid 30. The two zipper coils (which also could be rows of zipper teeth) are reversibly connected and separated by zipper pull 22. Other means could be employed to detachably secure the lid 30 to the body 40, enclosing the compartment 41, as is well known to those of skill in the art.

The carrying case 20 may be constructed of leather, nylon, dacron or polyester fabric, Naugahyde, vinyl or canvas or combinations thereof. The embodiment depicted in FIG. 1 is adapted to be a computer case and has handles 25. As is typical of computer cases, padding and possibly a hard nylon or other plastic shell can be incorporated into the walls of the carrying case 20 to protect portable computers and other components (such as a printer, modem and the like) contained within compartment 41. A padded securing strap 47 retains portable computers from sub-notebook to the largest size in the compartment 41. The securing strap 47 contains hook fasteners (not shown) at either end which secure to a loosely woven soft fabric lining the interior of the compartment 41.

It should be understood, however, that the article organizer assembly 50, may be employed with all types of carrying cases and not just computer cases. Examples of other such carrying cases include attache cases, brief cases, suitcases, flight bags, litigation bags, and backpacks.

The article organizer assembly 50 is described below in greater detail in connection with FIGS. 2–7. As seen in FIG. 1, the article organizer assembly 50 consists of a number of main or side panels defining and containing pockets for various articles such as pens, cards, floppy disks, and the like. A flap 51 is hingedly attached to a side panel of the article organizer assembly 50 and is shown in FIG. 1 to be generally in its first or retracted position. A lanyard strap 52 (best seen in FIGS. 3 and 6) connects a side panel of the article organizer assembly to the lower end of the flap 51.

The lid 30 of the carrying bag 20 has means to receive and thus attach to it the article organizer assembly 50. (The attachment means could be incorporated into any inside wall adjoining the compartment 41 that has suitable dimensions, such as the side of bottom wall 46 adjoining the compartment 41.) A pocket 31 on the inside wall or surface of the lid 30 forms a receptacle 32 into which the flap 51 of the article organizer assembly 50 may be inserted so that the article organizer assembly 50 is securely but removably attached to the lid 30. The article organizer assembly 50 is sized to fit within the compartment 41 when the lid 30 is secured to the body 40 of the carrying case 20. The slot 33 defined in the pocket 31 accommodates the lanyard strap 52 which, without the slot 33, would prevent full insertion of the flap 51 into the receptacle 32 behind the pocket 31.

The pocket 31 is relatively rigid and is preferably formed from a nylon or other relatively rigid sheeting contained within an envelope of fabric sewed into the lid 30. The nylon or other relatively rigid sheeting is necessary to make the pocket 31 rigid enough to securely hold the flap 51 against forces perpendicular to the lid 30 despite the indentation of the slot 33 in the pocket 31.

The arrangement of the combination of the article organizer assembly 50 and the carrying case 20 shown in FIG. 1 is useful for at least briefcase, attache case, and computer case applications. The user can prop the combination on his or her knees while seated (such as in an airplane, train or bus) and have ready access to the contents of the compartment 41 (which may contain, for example, a personal computer or writing materials) and also the articles contained in the article organizer assembly 50. On the other hand, when the user has more room, such as in a hotel room or office, the article organizer assembly 50 can be removed from the carrying case 20 and mounted on a table or desk in a generally upright position (as seen in FIG. 2) for ready access to the articles that the article organizer assembly 50 contains.

Figure 2:
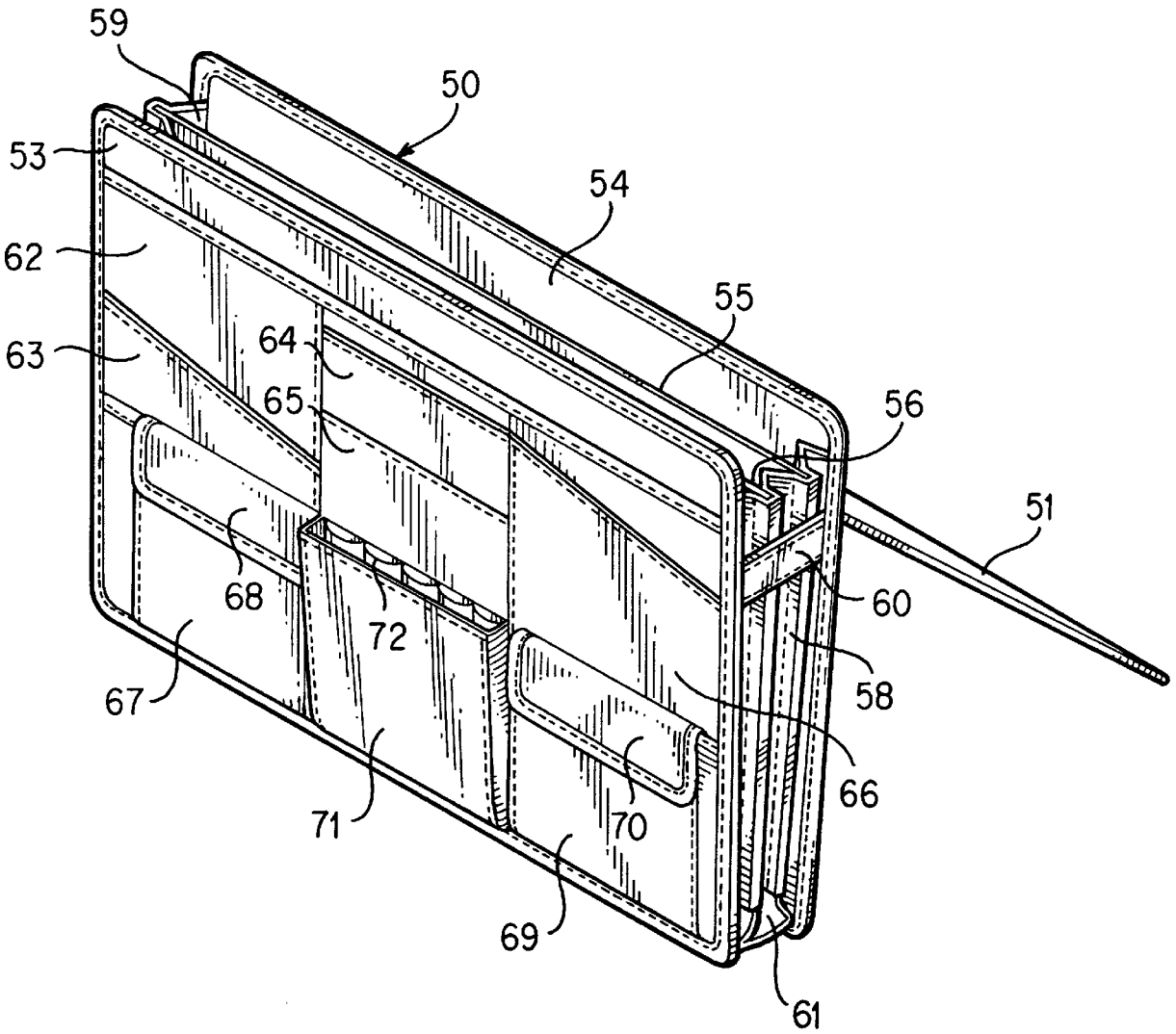
FIG. 2 is a perspective view of the article organizer assembly in the self-supporting mode.
Figure 6:
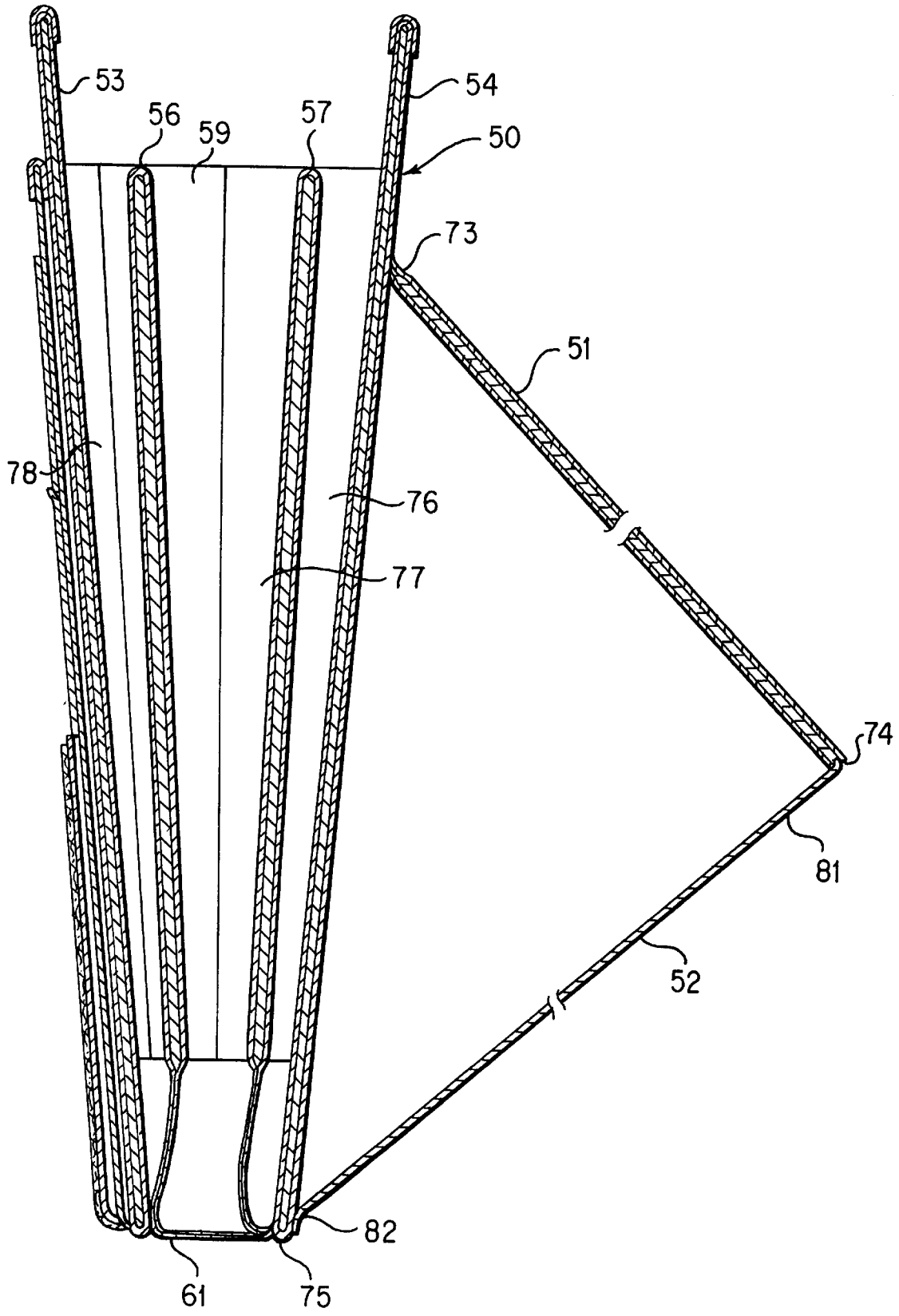
FIG. 6 is a cross-section of the article organizer assembly taken along lines 6—6 in FIG. 4.

FIG. 2 shows a perspective view of the preferred embodiment of the article organizer 50. Spaced first and second main or side panels 53 and 54 are joined by first and second end panels 58 and 59 and by bottom panel 61. The first and second side panels 53 and 54 are generally rigid or relatively stiff and, as best seen in crosssection in FIG. 6, are formed from generally rectangular sheets of nylon or other relatively rigid sheeting contained in envelopes of fabric, leather or plastic sheeting sewed or otherwise fastened together at their edges. In a preferred embodiment, the envelopes are made of polyester fabric and as shown in FIGS. 2 and 6, all edge seams are preferably taped in order to cover exposed fabric edges.

The first and second end panels 58 and 59 attached to the side panels 53 and 54 are made of fabric, leather or plastic sheeting. The first and second panels 58 and 59 are creased like a bellows and expand and contract to permit the first and second side panels 53 and 54 to diverge from and to approach each other. The bottom panel 61 is also made of a fabric, leather or plastic sheeting, and also permits expansion and contraction of the first and second side panels 53 and 54.

Spaced between first and second panels 53 and 54 are first and second reduced height interior panels 55 and 56. The interior panels 55 and 56 divide the compartment defined by the first and second side panels 53 and 54, the end panels 58 and 59, and the bottom panel 61 into three file compartments 76, 77 and 78 (best seen in FIGS. 4 and 6) for containing files, papers and the like. In effect, therefore, the second side panel 54 has pockets (for files) attached to it on its side opposite that to which the flap 51 is hingedly attached.

Hingedly attached to the second side panel 54 is the flap 51 which, in FIG. 2, is in its second or extended position in order to support the article organizer assembly 50 in a generally upright (but slanted) position. Alternative means for supporting the article organizer assembly in a generally upright position could be supplied. For example, a hinged and thus retractable wire or plastic bipod or monopod could be attached to the article organizer assembly. Such a hinged bipod or monopod might be provided with stops in the hinge to prevent hyperextension, just as the lanyard strap 52 prevents hyperextension of the flap 51 and thus retains the flap 51 in its second or extended position. The supporting means might not be used to attach the article organizer assembly 50 to an interior wall of the compartment 41 of the carrying case 20 if other means for that purpose, such as hook and loop fastening strips (such as VELCRO® hook and loop mating fastening strips), snaps, elastic straps and the like, are attached to the interior wall of the compartment 41 and the article organizer assembly 50.

A number of sheets of fabric, netting, leather or plastic sheeting are stitched to the exterior side of the first side panel 53 to form pockets 62, 63, 64, 65, 66, 67, 69, 71, and 72, in a manner well known to those of skill in the art. The pockets 67 and 69 are especially adapted for containing floppy disks and have pocket covers 68 and 70 that detachably fasten to the pockets 67 and 69 with hook and loop fastening strips (such as VELCRO® hook and loop fastening strips) in order to contain the floppy disks within these pockets. Pockets 72 are especially adapted to contain pens or other writing instruments. The remaining pockets can contain papers, PCMCIA or "PC" cards, business cards, credit cards, passports, money, paper clips, and other articles useful to a traveler.

Elastic straps 60 join the upper ends of the first and second side panels 53 and 54. These elastic straps 60 urge the first and second side panels 53 and 54 toward each other in order to keep the article organizer assembly 50 relatively flat and compact yet permitting expansion when necessary to accommodate thicker files in the file compartments 76, 77, and 78.

Figure 3:
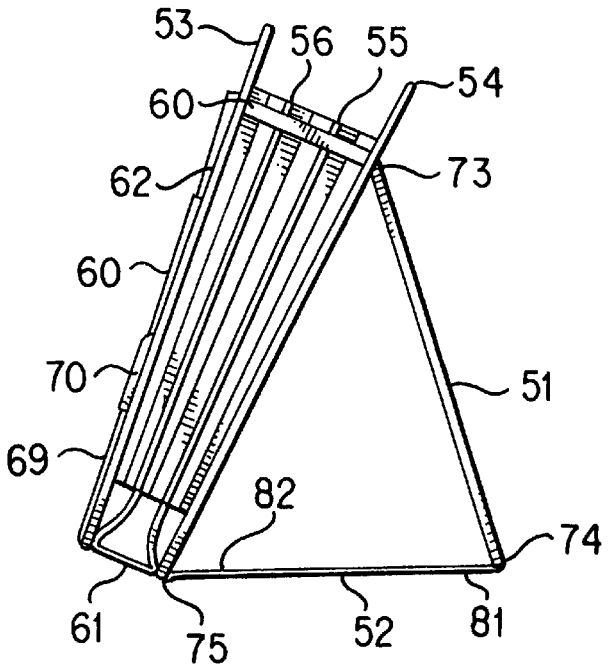
FIG. 3 is a side plan view of the article organizer assembly.

FIG. 3 shows a side view of the article organizer assembly 50. The flap 51 is again shown in its second or deployed position for holding the article organizer assembly 50 in a generally upright position after the article organizer assembly 50 is removed from the carrying case. The flap 51 is rigid or relatively stiff in order to serve as a prop for the article organizer assembly 50. The flap 51 is preferably constructed from a rigid nylon or other relatively rigid sheet contained in an envelope of light fabric. The flap 51 is hingedly attached along hinge line 73 to the second side panel 54. Preferably, the two layers of fabric that enclose a nylon or other relatively rigid sheet are stitched along the hinge line 73 to the back side of the second side panel 54.

The lanyard strap 52, which prevents hyperextension of the flap 51 is preferably formed by a sewn strip of fabric and has two ends 81 and 82. The end 81 of the lanyard strap 52 is sewn to the lower edge 74 of the flap 51. The other end 82 of the lanyard strap 52 is sewn into the lower edge 75 of the second side panel 54. The lanyard strap 52 is very flexible and offers no resistance to folding the flap 51 against the second side panel 54 in order to return the flap 51 to its retracted position.

Figure 4:
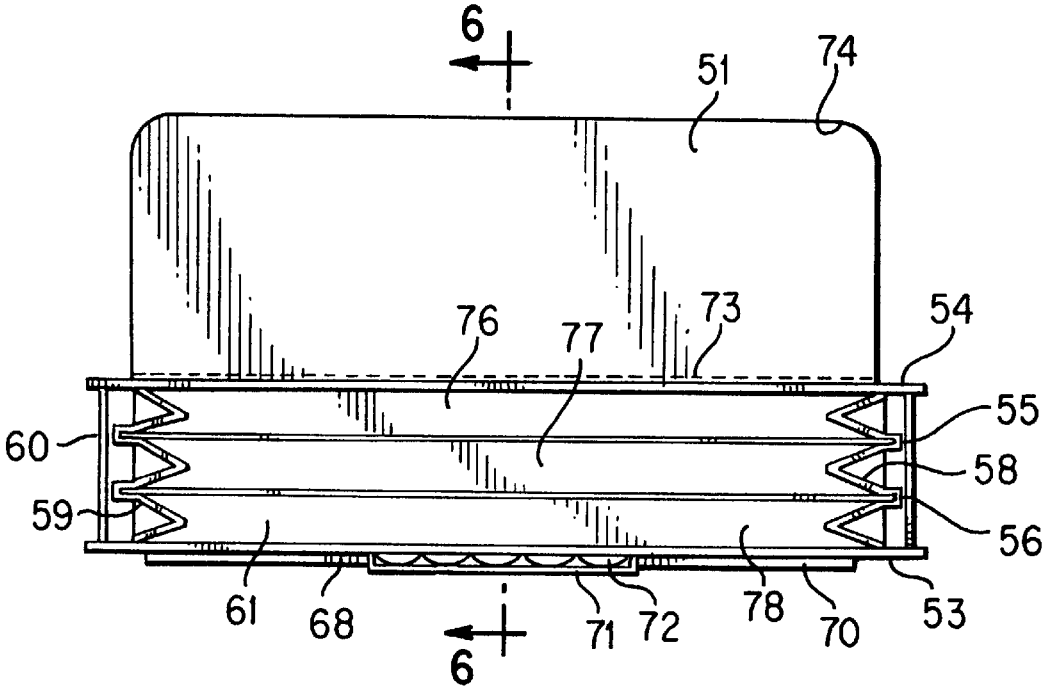
FIG. 4 is a top plan view of the article organizer assembly.

FIG. 4 shows a top view of the article organizer assembly 50. The first and second side panels 53 and 54, together with the interior panels 55 and 56 are spaced and generally parallel in order to define the sub-compartments 76, 77, and 78.

Figure 5:
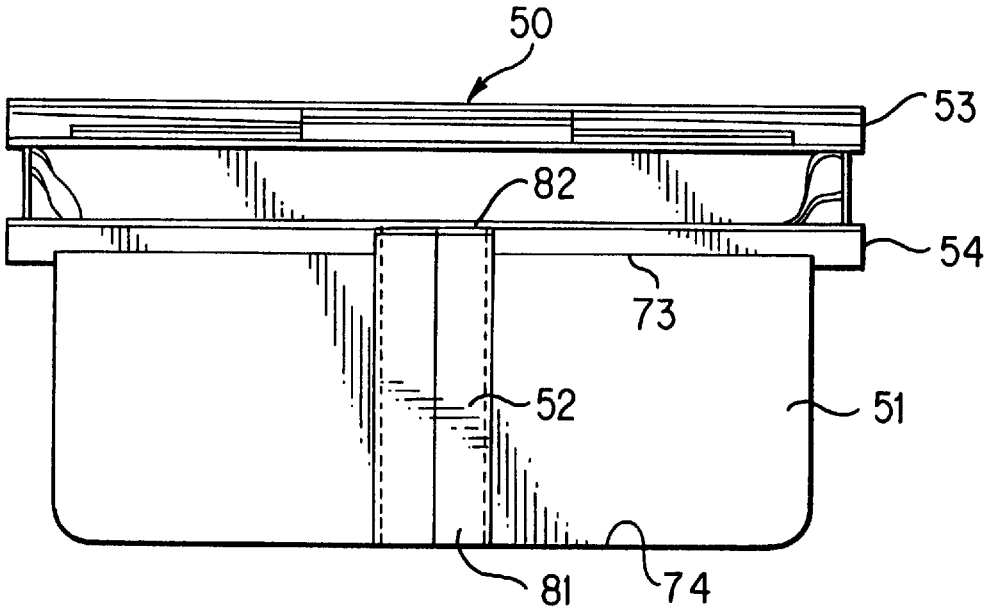
FIG. 5 is a bottom plan view of the article organizer assembly.

FIG. 5 shows a bottom view of the article organizer assembly 50 with the flap 51 in its second or extended position.

FIG. 6 shows a cross-section of the article organizer assembly 50 which further shows its construction. The first and second side panels 53 and 54 and the interior panels 55 and 56, as well as the flap 51 are each shown in this cross-section to be composed of a nylon or relatively rigid sheet surrounded by an envelope of fabric.

Figure 7:
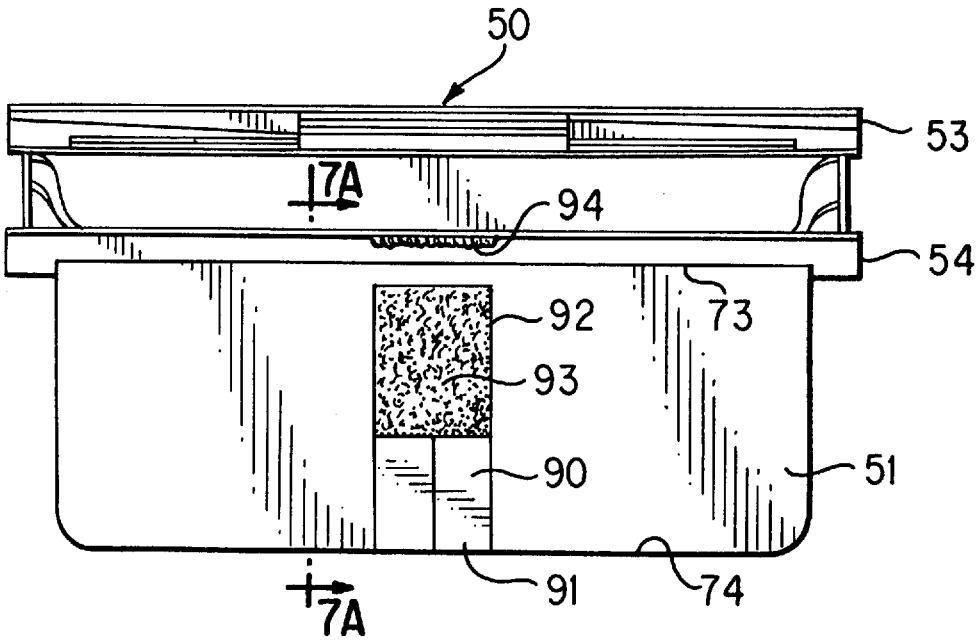
FIG. 7 is a bottom plan view of an alternate variant of the preferred embodiment of the article organizer assembly in which the lanyard strap is removably attached to a side panel of the article organizer assembly by hook and loop fasteners.

FIG. 7 shows a variant of the article organizer assembly 50 in which a different type of lanyard strap is employed. In this variation, a lanyard strap 90 is sewn at its end 91 to the lower edge 74 of the flap 51 but separably attached to the second side panel 54 by a hook and loop combination fastener. The end 92 of the lanyard strap 90 contains a strip of looped material 93 which separably attaches to a strip of hooked material 94 sewn onto the back wall of the second side panel 54. A partial cross-section (FIG. 7*a*) shows how the end 92 of the lanyard strap 90 is separably attached to the back side of the second side panel 54.

Figure 8:
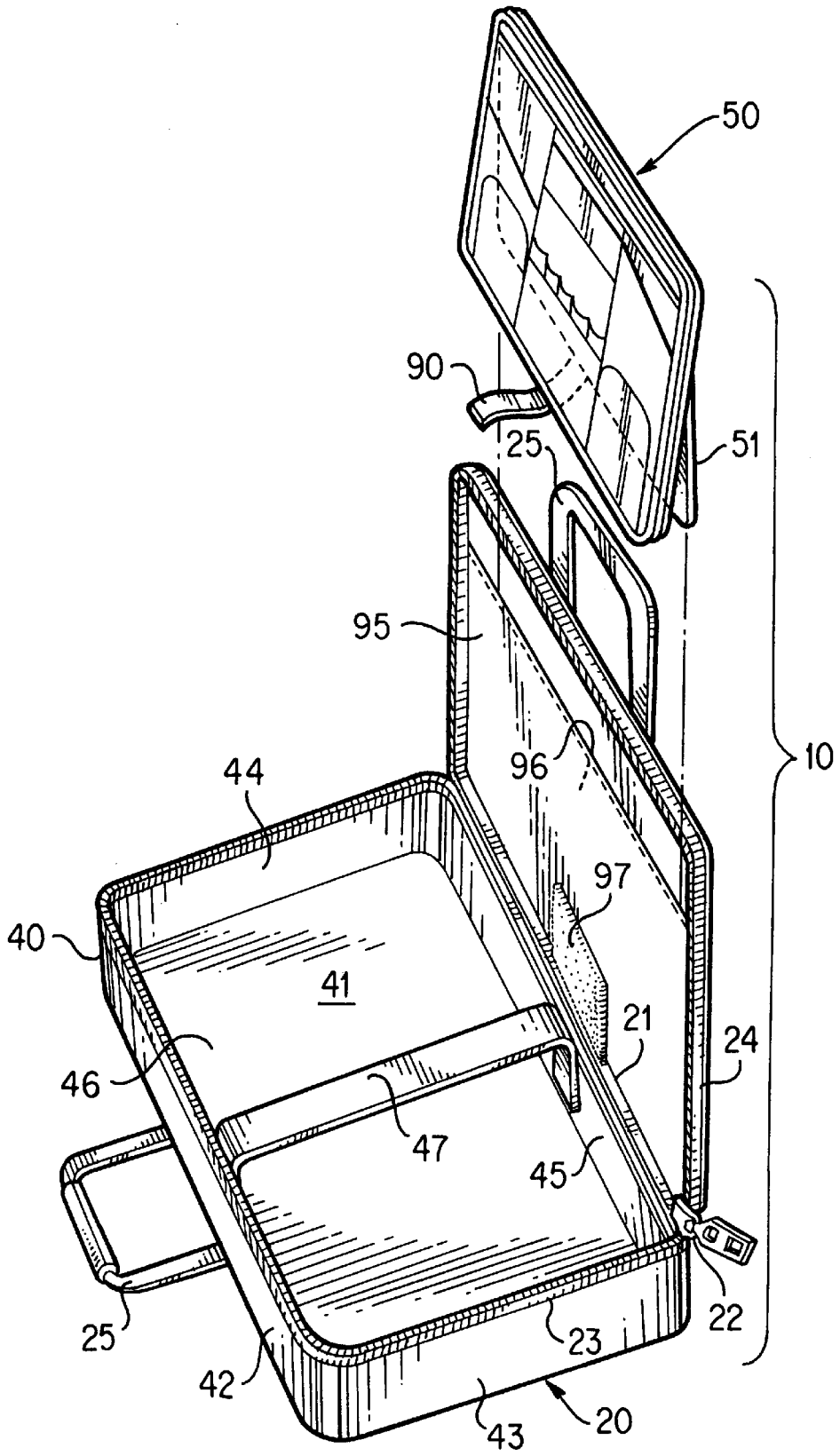
FIG. 8 is a perspective view of the article organizer assembly variant shown in FIGS. 7 and 7*a* and a carrying case adapted to receive this variant of the article organizer assembly.

FIG. 8 shows a modification of the carrying case 20 shown in FIG. 1 that is adapted to receive an article organizer 50 with the partially detachable lanyard strap 90. A pocket 95 is sewn into the inside surface or wall of the lid 30 and defines a receptacle 96 for receiving the flap 51. The pocket 95 need not be rigid.

Prior to the mounting of the article organizer assembly 50 with this variant of the lanyard strap, the second end 92 of the lanyard strap is detached from the second side panel 54 so that the flap 51 can be inserted into the receptacle 96 behind the pocket 95 inside the lid 30. The strip of hooked material 94 sewn to the second side panel 54 of the article organizer assembly 50 attaches to a strip of looped material 97 sewn onto the inside surface of the lid 30 to secure the article organizer assembly 50 to the lid 30.

Figure 7A:
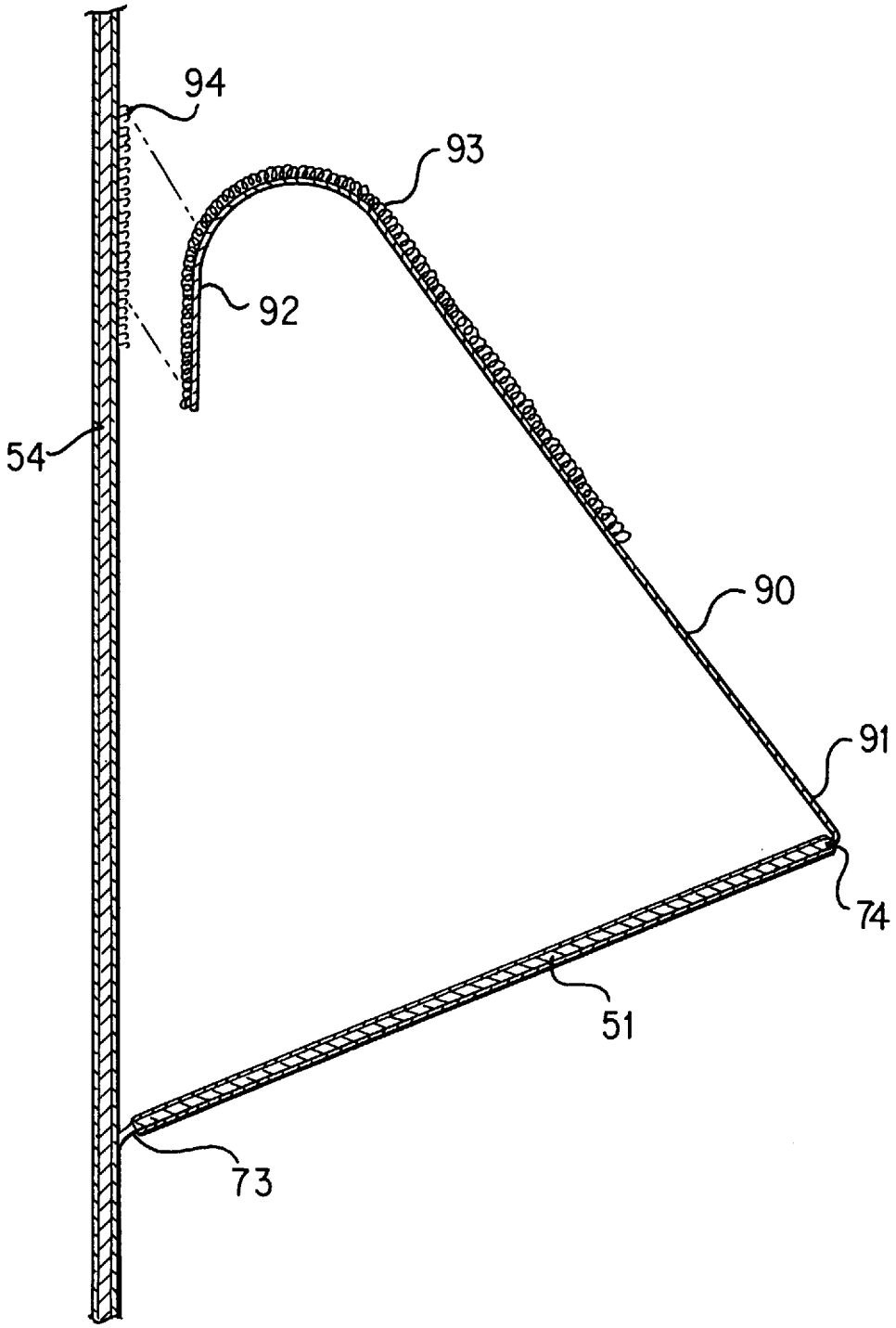
FIG. 7*a* is a partial cross-section of the article organizer assembly shown in FIG. 7 taken along the lines 7*a*—7*a*.

Of course, the variant of the article organizer assembly 50 with the partially detachable lanyard strap 90 shown in FIG. 7*a* could be mounted in a carrying case 20 of the kind shown in FIG. 1, although the construction of the pocket 31 in the carrying case 20 shown in FIG. 1 is more complex and expensive than is necessary.

The lanyard strap 90 could be detachable at either of its ends 91 and 92 by providing fastening devices such as hook and loop fasteners at either or both of these ends 91 and 92.

Figure 9:
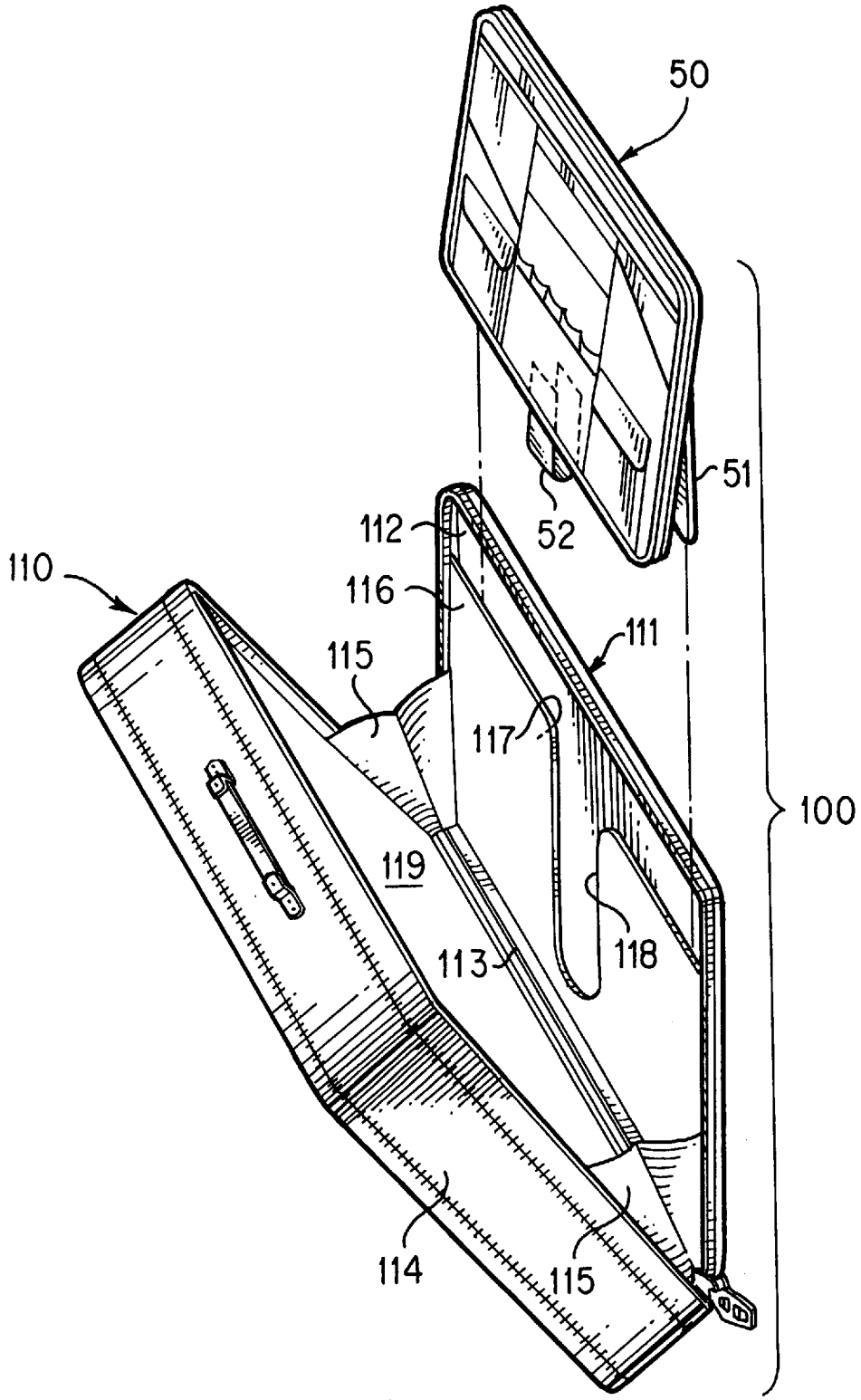
FIG. 9 is a perspective view of the article organizer assembly and a carrying case adapted to mount the article organizer assembly in a side compartment of the carrying case.

FIG. 9 shows the combination 100 of a multi-compartment carrying case 110 designed to receive an article organizer assembly 50 in a side pocket 111.

The side pocket 111 has a lid 112 hinged at its bottom 113 to the main body 114 of the carrying case 110. Bellows flaps 115, attached to the lid 112 and the main body 114, retain the lid 112 in an angled position when the lid 112 is unzipped from the main body 114 to allow presentation of the contents of the pocket 111 without allowing those contents to fall out of the pocket 111. The lid 112 has a pocket 116 attached to its inner surface that defines a receptacle 117 for receiving the flap 51 of the organizer assembly 50. A slot 118 in the pocket 116 accommodates the lanyard strap 52 of the organizer assembly 50. The construction of the pocket 116 is the same as that of the pocket 31 shown in FIG. 1.

The carrying case 110 will normally retain the article organizer assembly 50 within the compartment 119 defined by the pocket 111 and the main body 114 of the carrying case 110. The lid 112 of the pocket 111 may be unzipped to expose the compartment 119 within so as to expose the article organizer assembly 50 to access by the user. The user may leave the article organizer assembly 50 attached to the lid 112 and insert or remove articles from the various pockets of the article organizer assembly 50. Alternatively, the user may remove the article organizer assembly 50 from the pocket 111 in order to place the article organizer assembly 50 in a generally upright position on a table or the like for convenient access to the articles contained in the various pockets of the article organizer assembly 50.

While the invention has been described in detail with respect to certain and preferred embodiments, it should be understood that the invention is not limited to those precise embodiments, in that those embodiments are instead representative examples of the many modifications and variations which present themselves to those skilled in the art to which the invention pertains without departing from the scope and spirit of this invention, as defined in the appended claims.

What is claimed is:

1. A removable self-supporting article organizer assembly to be contained within a compartment of a carrying case, the compartment having an inside wall with a pocket attached to the inside wall and defining a receptacle, the article organizer assembly comprising:

a relatively rigid first panel having first and second sides and upper and lower edges, and sized to fit within the compartment of the carrying case, at least one pocket for containing articles on the first side of the first panel, and a relatively rigid flap having upper and lower edges that is hingedly connected at the upper edge of the flap to the first panel so that the flap has a first position in which the flap is next to the second side of the first panel and a second position in which the flap is angled away from the first panel in order to support the first panel in a generally upright position when the article organizer assembly is not contained in the compartment of the carrying case and the lower edges of the flap and the first panel are disposed on a supporting surface and the flap being shaped so as to be removably received within the receptacle defined by the pocket attached to the inside wall of the compartment of the carrying case in order for the article organizer assembly to be removably attached to the inside wall of the compartment when the article organizer assembly is contained within the compartment of the carrying case.

2. The article organizer assembly according to claim 1 in which a pocket for containing files is formed by a second panel spaced from the first side of the first panel and connected to the first panel by first and second end panels and a bottom panel.

3. The article organizer assembly according to claim 2 further comprising at least one inside panel spaced from and between the first and second panels so as to form at least two file compartments.

4. The article organizer assembly according to claim 2 further comprising at least one pocket for containing articles on a side of the second panel opposite the first panel.

5. The article organizer assembly according to claim 4 in which the pocket for containing articles is shaped to contain a floppy disk.

6. The article organizer assembly according to claim 1 further comprising means for preventing hyperextension of the the flap.

7. The article organizer assembly according to claim 6 in which the means for preventing hyperextension comprises a lanyard strap connected to and between the flap and the first panel for preventing hyperextension of the flap.

8. The article organizer assembly according to claim 7 in which the connection of the lanyard strap to one of the flap and the first panel is detachable so that the lanyard strap will not prevent insertion of the flap into the receptacle defined by the pocket attached to the inside wall of the compartment in the carrying case.

9. The combination of a carrying case and a removable self-standing article organizer assembly, comprising:

a carrying case having a compartment defined by a plurality of interior walls;

a pocket attached to one of the interior walls of the compartment for defining a receptacle;

an article organizer assembly comprising a relatively stiff first panel having first and second sides and upper and lower edges and sized to fit within the compartment of the carrying case, at least one pocket for containing articles on the first side of the first panel, and a relatively stiff flap with upper and lower edges, the upper edge of the flap being hingedly connected to the first panel so that the flap can assume a first position adjacent to the second side of the first panel and a second position in which the flap is angled away from the first panel in an extended position for supporting the article organizer assembly in a generally upright position when the article organizer assembly is removed from the carrying case and the lower edges of the flap and the first panel are disposed on a supporting surface, the flap being shaped so as to be removably received within the receptacle defined by the pocket attached to one of the interior walls of the compartment in the carrying case in order for the article organizer assembly to be removably attached to the interior wall when the article organizer assembly is contained within the compartment of the carrying case.

10. The combination according to claim 9 further comprising a lanyard strap connected to and between the flap and the first panel for preventing hyperextension of the flap.

11. The combination according to claim 10 in which the connection of the lanyard strap to one of the flap and the first panel is detachable so that the lanyard strap will not prevent insertion of the flap into the receptacle defined by the pocket attached to the inside wall of the compartment in the carrying case.

12. The combination according to claim 10 in which the pocket has a slot defined therein for accommodating the lanyard strap when the flap is inserted into the receptacle.

13. The combination according to claim 12 in which the pocket is relatively rigid.

14. The combination according to claim 9 in which the article organizer assembly further comprises a second panel spaced from the first side of the first panel and connected to the first panel by first and second end panels and a bottom panel for defining a file compartment for containing files.

15. The combination according to claim 9 in which the pocket for containing articles is shaped to contain a floppy disk.

16. A carrying case for removably containing a self-standing article organizer assembly having at least one generally rigid panel with an upper and a lower edge, comprising:

a body and a lid hinged to each other and capable of being closed and reversibly fastened together, the body and the lid having interior walls that define an interior compartment sized to receive and removably contain the article organizer assembly, and a pocket attached to one of the interior walls of the lid and the body and defining a receptacle shaped for removably receiving a generally rigid flap having upper and lower edges and being hingedly connected at the upper edge of the flap to the panel of the article organizer assembly and capable of being angled away from the panel so that the article organizer assembly will be supported in a generally upright position when the lower edge of the flap and the lower edge of the panel are disposed on a supporting surface.

17. The carrying case according to claim 16 further comprising a slot in the pocket for accommodating a lanyard strap connected between the flap and the panel of the article organizer assembly.

* * * * *